US008554122B2

(12) United States Patent
Asakawa et al.

(10) Patent No.: US 8,554,122 B2
(45) Date of Patent: Oct. 8, 2013

(54) FIXING DEVICE AND IMAGE FORMING APPARATUS PROVIDED WITH SAME

(75) Inventors: Masaya Asakawa, Osaka (JP); Takashi Yamanaka, Osaka (JP); Hirokazu Nakamura, Osaka (JP); Noriko Inoue, Osaka (JP); Masaki Amemiya, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 294 days.

(21) Appl. No.: 13/053,521

(22) Filed: Mar. 22, 2011

(65) Prior Publication Data

US 2011/0249996 A1 Oct. 13, 2011

(30) Foreign Application Priority Data

Apr. 8, 2010 (JP) ..... 2010-089472

(51) Int. Cl.
*G03G 15/20* (2006.01)

(52) U.S. Cl.
USPC ..... 399/323

(58) Field of Classification Search
USPC ..... 399/323
See application file for complete search history.

(56) References Cited

U.S. PATENT DOCUMENTS

| | | | | |
|---|---|---|---|---|
| 6,453,128 | B2 | 9/2002 | Park | |
| 6,908,683 | B2 | 6/2005 | Ohahsi | |
| 2001/0016134 | A1 | 8/2001 | Park | |
| 2005/0008408 | A1 * | 1/2005 | Inomata | 399/323 |

FOREIGN PATENT DOCUMENTS

| | | |
|---|---|---|
| JP | 11-231711 | 8/1999 |
| JP | 2001-337533 | 12/2001 |
| JP | 2002-287553 | 10/2002 |
| JP | 2005-173447 | 6/2005 |
| JP | 2007-047380 | 2/2007 |

* cited by examiner

*Primary Examiner* — Walter L Lindsay, Jr.
*Assistant Examiner* — Barnabas Fekete
(74) *Attorney, Agent, or Firm* — Renner, Otto, Boisselle & Sklar, LLP

(57) ABSTRACT

A fixing device is provided in which a rotation member and a roller are caused to rotate pressing against each other, a recording paper is sandwiched and transported in a nip region between the rotation member and the roller, a leading edge of a peeling plate is positioned with respect to a peripheral surface of the rotation member, and the recording paper is separated from the rotation member by the peeling plate. In this fixing device, a surface of the peeling plate faces a transport route of the recording paper. Furthermore, in this fixing device, a contact member is provided that contacts a rear surface of the peeling plate displaced in a direction in which the leading edge of the peeling plate approaches the peripheral surface of the rotation member and prohibits displacement of the peeling plate after contact of the peeling plate to the contact member.

10 Claims, 9 Drawing Sheets

FIXING DEVICE AND IMAGE FORMING APPARATUS PROVIDED WITH SAME

BACKGROUND OF THE INVENTION

This application claims priority under 35 U.S.C. §119(a) on Patent Application No. 2010-89472 filed in Japan on Apr. 8, 2010, the entire contents of which are herein incorporated by reference.

The present invention relates to fixing devices that fix toner images formed on recording paper, and to image forming apparatuses including the same.

This type of fixing device is applied in image forming apparatuses that use methods such as electrography, electrostatic recording, and magnetography or the like, and sandwich between a pair of fixing rollers a recording paper (such as plain paper, electrostatic recording paper, and photographic papers or the like) on which a toner image has been formed, thereby applying heat and pressure to fix the toner image onto the recording paper.

In these fixing devices, the recording paper sometimes winds around the fixing roller, and therefore the leading edge of a peeling plate is positioned near a peripheral surface of the fixing roller such that recording papers are peeled off from the fixing roller by the peeling plate. For example, in JP 2002-287553A (hereinafter referred to as patent document 1), the peeling plate and a member that backs up the peeling plate are integrated such that the peeling plate is supported and positioned. Furthermore, in JP 2002-91222A (hereinafter referred to as patent document 2), the peeling plate is supported and positioned by being laser spot welded.

In this regard, it is necessary for the leading edge of each of the above-mentioned peeling plates to be positioned near the peripheral surface of the fixing roller. However, when a blockage (jam) of recording papers occurs in the vicinity of the peeling plate of the fixing roller such that transport of the recording paper is interrupted and the peeling plate is pressed on by the recording paper, sometimes the leading edge of the peeling plate pushes against the surface of the fixing roller such that the surface of the fixing roller is damaged.

With the structures of the fixing devices of patent document 1 and patent document 2, it is probable that the leading edge of the peeling plate will push strongly against the surface of the fixing roller, and no countermeasure is devised against this problem.

Accordingly, the present invention has been devised to address the above-described issue, and it is an object thereof to provide a fixing device and an image forming apparatus provided with the same in which damage is not caused to the surface of the fixing roller by the leading edge of the peeling plate even if a jam occurs.

SUMMARY OF THE INVENTION

In order to address these issues, in a fixing device according to the present invention in which a rotation member and a roller are caused to rotate pressing against each other, a recording paper is sandwiched and transported in a nip region between the rotation member and the roller, a leading edge of a peeling plate is positioned with respect to a peripheral surface of the rotation member, and the recording paper is separated from the rotation member by the peeling plate; a surface of the peeling plate faces a transport route of the recording paper, and a contact member is provided that contacts a rear surface of the peeling plate displaced in a direction in which the leading edge of the peeling plate approaches the peripheral surface of the rotation member and prohibits displacement of the peeling plate after contact of the peeling plate to the contact member.

With this fixing device according to the present invention, even if a recording paper on the transport route becomes blocked and a jam occurs such that the surface of the peeling plate is pushed by the recording paper and the peeling plate is displaced in a direction such that the leading edge of the peeling plate approaches the peripheral surface of the rotation member, displacement of the peeling plate after contact of the contact member to the rear surface of the peeling plate is prohibited, and therefore the leading edge of the peeling plate does not push against the peripheral surface of the rotation member.

Furthermore, in the fixing device according to the present invention, the contact member may be provided apart from the rear surface of the peeling plate and may contact the rear surface of the peeling plate when the leading edge of the peeling plate is displaced in a direction so as to approach the peripheral surface of the rotation member.

By providing the contact member apart from the rear surface of the peeling plate in this manner, the leading edge of the peeling plate can be positioned without any relation to the contact member.

Further still, in the fixing device according to the present invention, the contact member may have an end portion having irregularities so as to contact multiple locations of the rear surface of the peeling plate.

In a case where the end portion having irregularities of the contact member is caused to contact multiple locations of the rear surface of the peeling plate in this manner, the displacement amount of the peeling plate can be set by regulating the dimension of protrusion portions of the end portion of the contact member, and this is easier than regulating the dimensions of the entire contact member end portion.

In this regard, in an image forming apparatus, sometimes the recording paper passes between the peripheral surface of the fixing roller and the leading edge of the peeling plate, and in this case the recording paper reaches sensors and a thermostat near the fixing roller, thereby causing faulty detections in these devices and faulty operation in the temperature control of the fixing roller, and in a worst case may lead to abnormal temperature rises.

However, with the structures of the fixing devices in the above-mentioned prior art of patent document 1 and patent document 2, it is probable that the recording paper will pass through between the peripheral surface of the fixing roller and the leading edge of the peeling plate, and no countermeasure is devised against this problem.

In contrast to this, the fixing device according to the present invention is directed to a fixing device in which a rotation member and a roller are caused to rotate pressing against each other, a recording paper is sandwiched and transported in a nip region between the rotation member and the roller, a leading edge of a peeling plate is positioned with respect to a peripheral surface of the rotation member, and the recording paper is separated from the rotation member by the peeling plate, wherein the surface of the peeling plate faces the transport route of the recording paper, and a stopper is provided, which any recording paper strikes against that has passed through between the leading edge of the peeling plate and the peripheral surface of the rotation member to enter to a rear surface side of the peeling plate.

With the fixing device according to the present invention, any recording paper that passes between the leading edge of the peeling plate and the peripheral surface of the rotation member and enters to the rear surface side of the peeling plate strikes against the stopper, and therefore it is possible to prevent the entire recording paper from entering to the rear surface side of the peeling plate.

Furthermore, in the fixing device according to the present invention, the stopper may be a bent panel member, and a portion of the panel member from a bent location to a leading edge of the panel member may face between the leading edge of the peeling plate and the peripheral surface of the rotation member such that any recording paper that enters to the rear surface side of the peeling plate strikes against the stopper.

Further still, in the fixing device according to the present invention, the peeling plate may be arranged along a lengthwise direction of the rotation member, each end of the peeling plate may be supported by a respective holder, and the leading edge of the peeling plate is positioned with respect to the peripheral surface of the rotation member by causing the holders to contact the peripheral surface of end portions of the rotation member.

Next, an image forming apparatus according to the present invention is provided with a fixing device according to the present invention.

In an image forming apparatus according to the present invention, equivalent effects are achieved as with a fixing device according to the present invention.

DESCRIPTION OF EMBODIMENTS

Hereinafter, embodiments of the present invention are described in detail with reference to the accompanying drawings.

Figure 1:
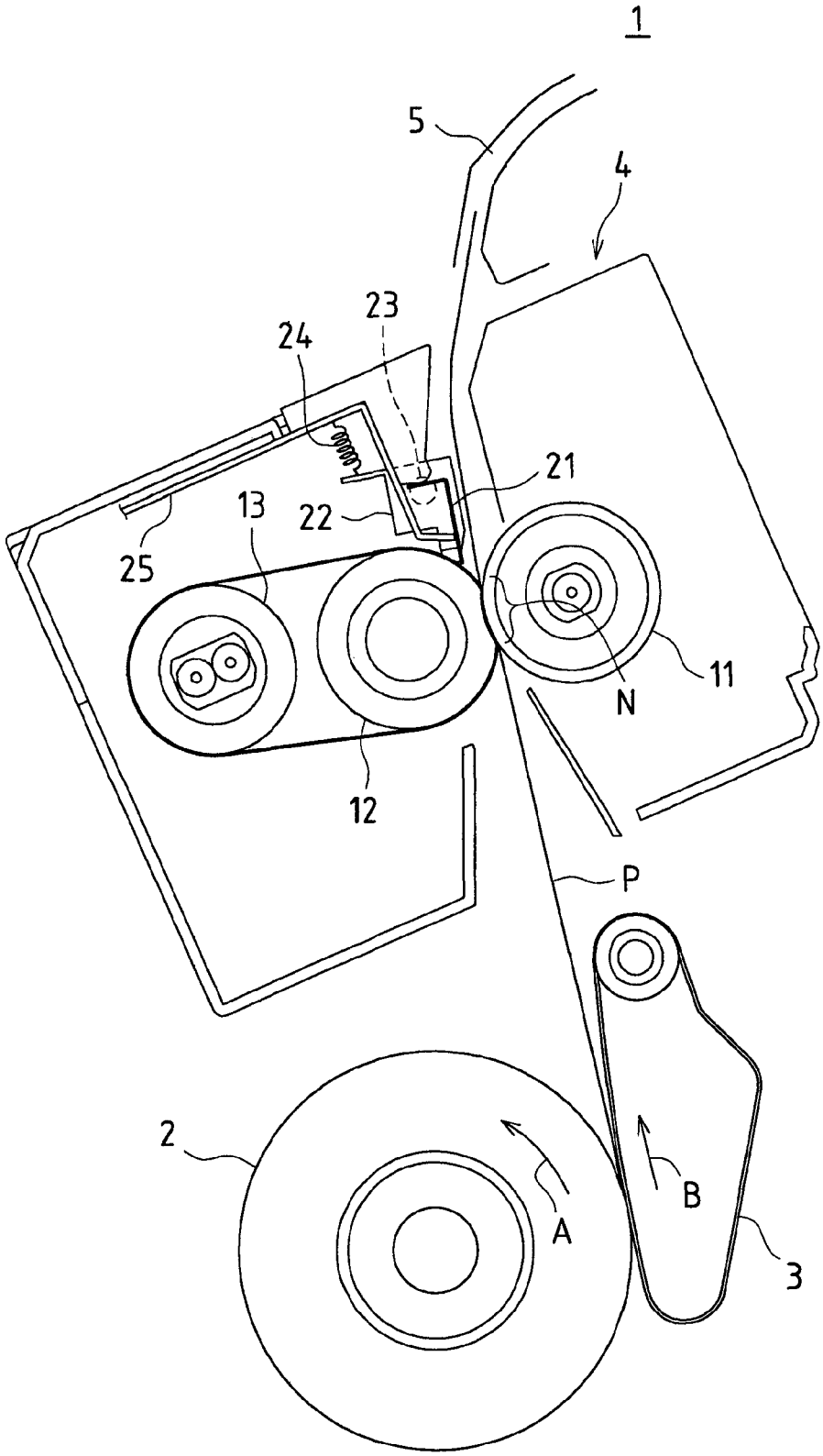
FIG. 1 is a cross-sectional view showing an enlargement of principal portions of an image forming apparatus in which one embodiment of a fixing apparatus according to the present invention has been applied.

FIG. 1 is a cross-sectional view showing an enlargement of principal portions of an image forming apparatus in which one embodiment of a fixing apparatus according to the present invention has been applied. An image forming apparatus 1 is based on an electrographic method and is provided with components such as a photosensitive drum 2, a transfer belt 3, and a fixing device 4. The photosensitive drum 2 has a photosensitive layer on its outer surface and is rotationally driven in the direction of arrow A at a constant rotational velocity. Accompanying rotation of the photosensitive drum 2, the surface of the photosensitive drum 2 is charged uniformly to a predetermined electric potential by a charging device (not shown in drawings), an electrostatic latent image is formed on the surface of the photosensitive drum 2 by an exposure device (not shown in drawings), and the electrostatic latent image on the surface of the photosensitive drum 2 is developed into a toner image by a development device (not shown in drawings).

The transfer belt 3 is orbitally driven in the direction of arrow B at the same velocity as the surface velocity of the photosensitive drum 2 and presses against the photosensitive drum 2 such that a nip region forms therebetween. A recording paper P that is transported in from there-below is introduced to the nip region, and a toner image on the surface of the photosensitive drum 2 is transferred onto the recording paper P while the recording paper P is transported in the nip region. A high voltage transfer bias (a high voltage that has opposite polarity (+) to the charge polarity (−) of the toner) is applied to the transfer belt 3 to achieve transfer of the toner image.

The recording paper P is transported upward (downstream in the transport direction) and guided to the fixing device 4 where it is subjected to heat and pressure such that the toner image on the recording paper P is fixed. This recording paper P is transported further upward (downstream in the transport direction) through a transport route 5 and discharged into a discharge tray (not shown in drawings) or the like.

Figure 2:
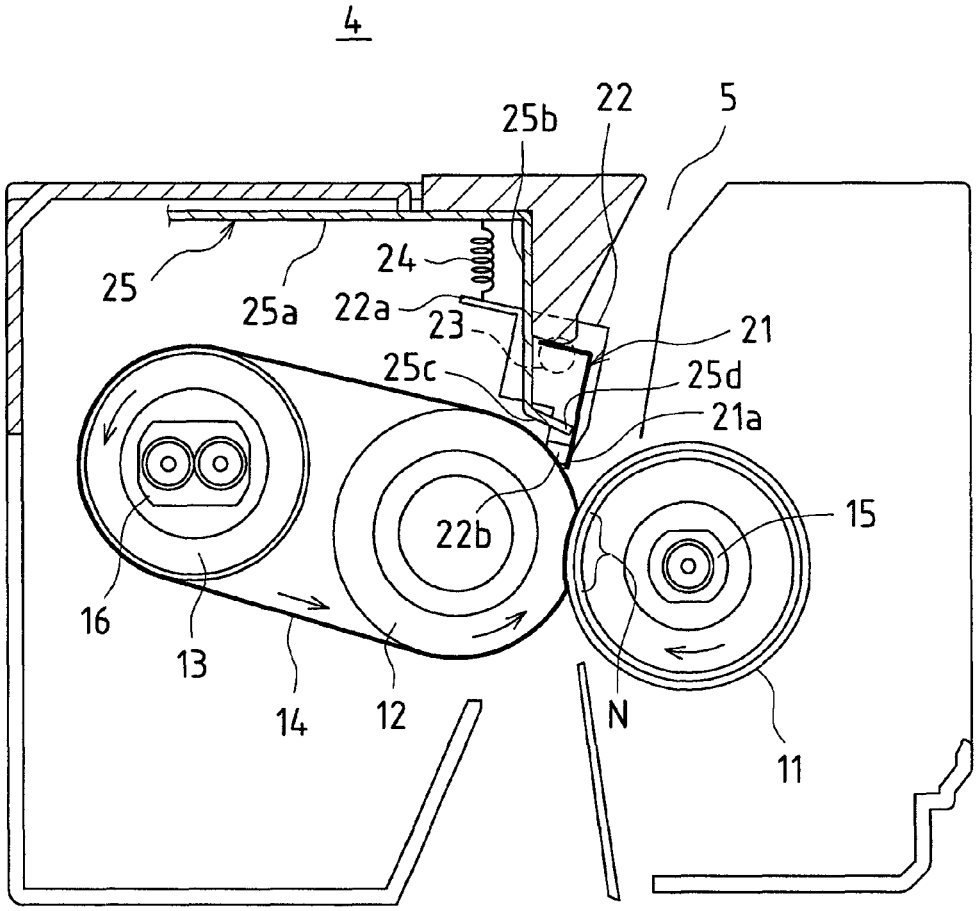
FIG. 2 is a cross-sectional view showing the fixing device of FIG. 1.

FIG. 2 is a cross-sectional view showing the fixing device 4 according to the present embodiment. The fixing device 4 shown in FIG. 2 is provided with a pressure roller 11, a heat roller 12, a heating assistance roller 13, and an endless fixing belt 14 that spans between the heat roller 12, and the heating assistance roller 13, and a nip region N is formed between the fixing belt 14 and the pressure roller 11 by the pressure roller 11 and the heat roller 12 pushing against each other through the fixing belt 14.

In this fixing device 4, a rotational driving force from the image forming apparatus side is transmitted to at least one of the shafts of the pressure roller 11, the heat roller 12, and the heating assistance roller 13, and each of the pressure roller 11, the heat roller 12, and the heating assistance roller 13 is rotated or idly rotates in the direction shown by its arrow. The recording paper is sandwiched and transported in the nip region N between the fixing belt 14 and the pressure roller 11, and is subjected to heat and pressure in this nip region N. Due to this, the toner image on the recording paper is thermally fixed to the recording paper by being melted, mixed, and pressed.

The pressure roller 11 is a roller having a three-layer structure in which an elastic layer is provided on an outer surface of a hollow shaft and a mold release layer is formed on an outer surface of the elastic layer. A heat source heater lamp (halogen lamp) 15 for heating the pressure roller 11 is provided inside the pressure roller 11 (inside the hollow shaft).

The heat roller 12 is a component in which an elastic layer is provided on an outer surface of a hollow shaft, and the elastic layer is provided with a sufficient thickness.

The fixing belt 14 is an endless belt constituted by a material having favorable thermal conduction properties, and its outer peripheral surface is provided with a mold release layer.

The heating assistance roller 13 is a component in which the outer surface of a hollow shaft is the surface layer thereof, and a heat source heater lamp (halogen lamp) 16 for heating the heating assistance roller 13 is provided inside the heating assistance roller 13 (inside the hollow shaft).

Here, since the elastic layer of the heat roller 12 is provided with a sufficient thickness, when the pressure roller 11 and the heat roller 12 push against each other through the fixing belt 14, the elastic layer of the heat roller 12 becomes greatly depressed such that a wide nip region N is formed between the fixing belt 14 and the heat roller 12.

When each of the pressure roller 11, the heat roller 12, and the heating assistance roller 13 rotates in the direction of its arrow, the fixing belt 14 is heated by the heating assistance roller 13 while being orbitally moved through the nip region N. When a recording paper is transported through the nip region N in this state, the recording paper is subjected to heat and pressure by the fixing belt 14 and the pressure roller 11, and the toner image on the recording paper becomes fixed.

On the other hand, a peeling plate 21 is arranged near the peripheral surface of the fixing belt 14, and a leading edge 21*a* of the peeling plate 21 is positioned slightly apart from the peripheral surface of the fixing belt 14. Specifically, the leading edge 21*a* of the peeling plate 21 is arranged suspended above the peripheral surface of the fixing belt 14, and although the leading edge 21*a* of the peeling plate 21 and the peripheral surface of the fixing belt 14 are close to each other, they are apart from each other and do not make contact. The peeling plate 21 is a component for peeling off any recording paper that is wound onto the fixing belt 14.

Figure 3:
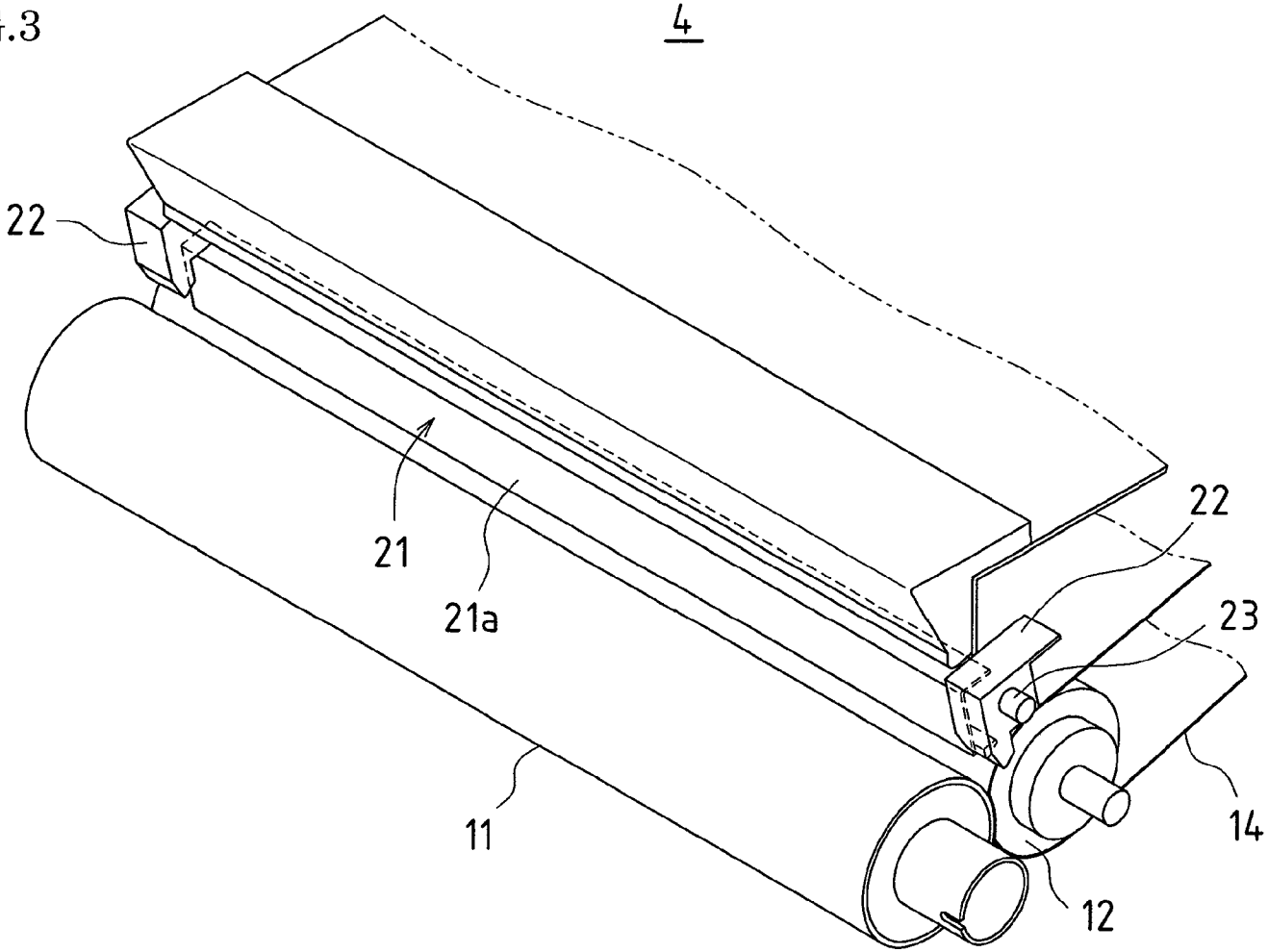
FIG. 3 is a perspective view showing components such as a pressure roller, a fixing belt, and a peeling plate in the fixing device of FIG. 1 as viewed from a front side.

FIG. 3 is a perspective view showing components such as the pressure roller 11, the fixing belt 14, and the peeling plate 21 in the fixing device 4 as viewed from a front side. As shown in FIG. 3, each of both ends of the peeling plate 21 along a shaft 23 direction is supported by a holder 22, and the leading edge 21*a* of the peeling plate 21 between the holders 22 faces the peripheral surface of the fixing belt 14.

As shown in FIG. 2 and FIG. 3, each of the holders 22 is supported so as to readily rotate centered on the shaft 23, and an upper end portion 22*a* of each of the holders 22 is pulled upward (outward away from the heat roller 12) by a coil spring 24 such that each of the holders 22 is biased in a clockwise direction centered on the shaft 23. A leg portion 22*b* is provided for each of the holders 22, and when each of the holders 22 is biased in a clockwise direction by the coil spring 24, a bottom surface of the each of the leg portions 22*b* pushes against and makes contact with an edge portion of the peripheral surface of the fixing belt 14.

The peeling plate 21 is formed by a thin metal panel bent into an L shape, and each of its end portions is supported by the holders 22. The peeling plate 21 is biased in the clockwise direction along with the holders 22 such that its leading edge 21*a* is positioned slightly apart from the peripheral surface of the fixing belt 14 by the contact of the leg portions 22*b* of the holders 22 against the peripheral surface of the fixing belt 14.

It should be noted that although the bottom surface of the leg portions 22*b* of the holders 22 slide in contact with the edge portions of the peripheral surface of the fixing belt 14 accompanying orbital movement of the fixing belt 14, the edge portions of the peripheral surface of the fixing belt 14 are regions that do not contact the recording papers and do not have any effect on the fixing of the recording papers. Thus, it is not a problem for the edge portions of the peripheral surface of the fixing belt 14 to become worn or marked by the sliding contact with the bottom surfaces of the leg portions 22*b*.

Figure 4:
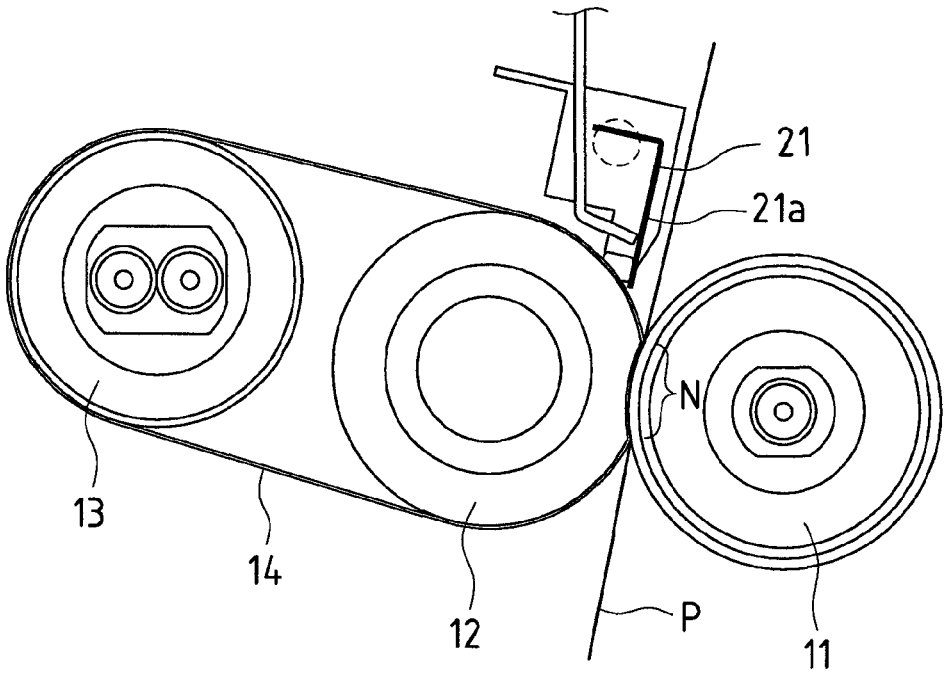
FIG. 4 is a cross-sectional view showing a process in which a recording paper passes through a nip region between a fixing belt and a pressure roller.

Here, as shown in FIG. 4, since the elastic layer of the heat roller 12 greatly depresses, the nip region N becomes a C shape as viewed laterally in the nip region N between the fixing belt 14 and the pressure roller 11. Although the surface of toner image transfer of the recording paper contacts the peripheral surface of the fixing belt 14 and the recording paper adheres to the peripheral surface of the fixing belt 14, the recording paper P readily peels off the upper end portion of the nip region N since there is large curvature at the upper end portion of the C shaped nip region N.

Figure 5:
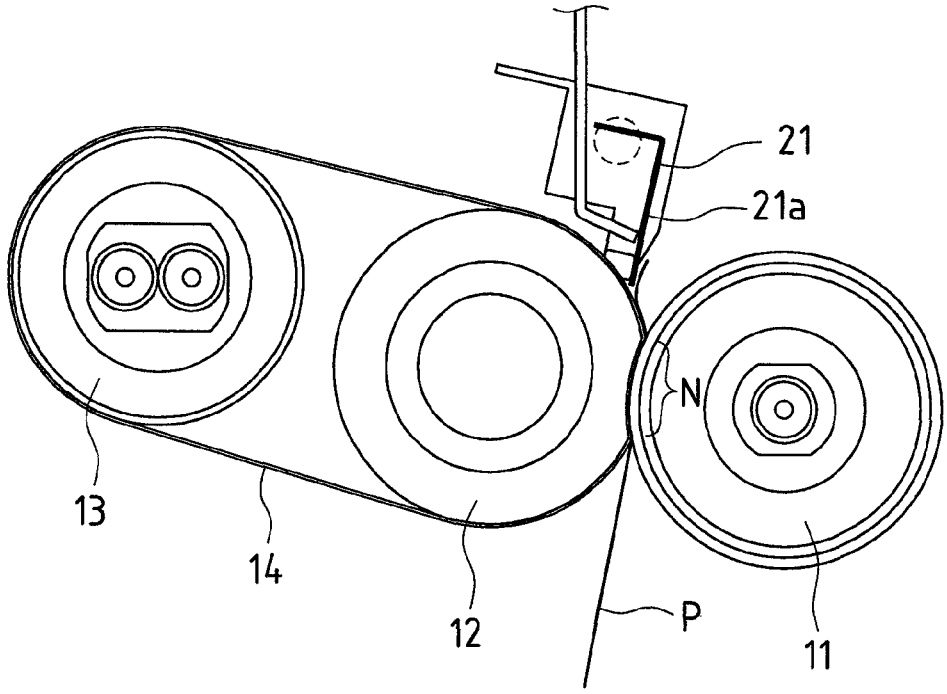
FIG. 5 is a cross-sectional view showing a process in which a recording paper is peeled off from the fixing belt by a peeling plate.

Furthermore, an empty void region is provided (is present) near the edges of the recording paper. Thus, even if there is a state in which the recording paper P adheres and winds onto the peripheral surface of the fixing belt 14 as shown in FIG. 5, due to the empty void region near the edges of the recording paper P, the leading edge of the recording paper P lifts off from the fixing belt 14 and catches on the leading edge 21*a* of the peeling plate 21, and the recording paper P is peeled off from the fixing belt 14 by the peeling plate 21.

Figure 6:
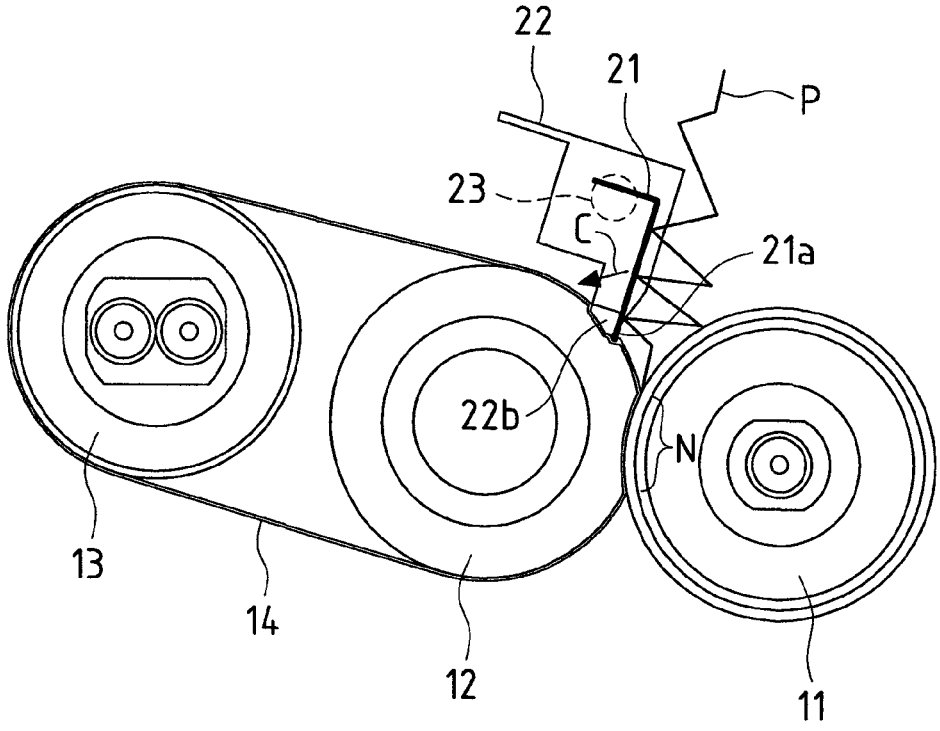
FIG. 6 is a cross-sectional view showing how the peeling plate is pushed by a recording paper that has become blocked in the nip region between the fixing belt and the pressure roller, and the leading edge of the peeling plate presses against the fixing belt.

In this regard, when a recording paper that has passed through the nip region N becomes blocked and a jam occurs as shown in FIG. 6, the recording paper P becomes kinked such that transport of the recording paper P stalls, and the recording paper P pushes the surface of the peeling plate 21 so as to attempt to displace the peeling plate 21 in the direction C shown by the arrow. If this displacement of the peeling plate 21 in the direction C is left as it is, the leg portions 22*b* of the holders 22 at the ends of the peeling plate 21 put pressure against the peripheral surface of the heat roller 12 through the fixing belt 14, and the peripheral surface of the heat roller 12 depresses at the locations of the leg portions 22*b* such that the leg portions 22*b* sink. Then, when the holders 22 rotate in the clockwise direction such that there is a state in which the leading edge of the peeling plate 21 is pushed against the fixing belt 14, the peripheral surface of the fixing belt 14 becomes damaged. As stated earlier, the surface of toner image transfer of the recording paper contacts the peripheral surface of the fixing belt 14, and therefore any damage to the fixing belt 14 directly affects the fixing characteristics of the toner image onto the recording paper and is a cause of deterioration in picture quality.

Furthermore, sometimes the recording paper P passes between the peripheral surface of the fixing belt 14 and the leading edge of the peeling plate 21, and if this is left as it is, the recording paper P enters to the rear surface side of the peeling plate 21 to reach sensors and a thermostat near the heating assistance roller 13, thereby causing faulty detections in these devices and faulty operation in the temperature control of the heating assistance roller 13 and the like, and in a worst case may lead to abnormal temperature rises.

Accordingly, in the fixing device 4 according to the present embodiment, a restriction panel 25 is provided at the rear surface side of the peeling plate 21 as shown in FIG. 2, and this restriction panel 25 prohibits displacement of the peeling plate 21 in the direction C in which the leading edge 21*a* of the peeling plate 21 approaches the peripheral surface of the fixing belt 14, and also deters recording papers from entering to the rear surface side of the peeling plate 21.

Next, detailed description is given regarding the restriction panel 25. As shown in FIG. 2, the restriction panel 25 is a bent metal panel, and is provided with a secured portion 25*a* on an upper side, a support portion 25*b* that drops from one end of the secured portion 25*a*, and a stopper portion 25*c* that extends from a lower end of the support portion 25*b* diagonally downward to the rear surface of the peeling plate 21 along an outer peripheral tangent direction of the heat roller 12, with a leading edge of the stopper portion 25*c* (restriction panel 25) being a contact end portion 25*d*.

The contact end portion 25*d* of the restriction panel 25 faces the rear surface of the peeling plate 21 near the leading edge 21*a* of the peeling plate 21 and is positioned so as to be slightly apart from the rear surface of the peeling plate 21. Specifically, the contact end portion 25*d* of the restriction panel 25 is arranged suspended above the rear surface of the peeling plate 21, and although at ordinary times the contact end portion 25*d* of the restriction panel 25 and the rear surface of the peeling plate 21 are close to each other, they are apart from each other and do not make contact. Furthermore, the lower surface of the stopper portion 25*c* faces towards the gap between the leading edge 21*a* of the peeling plate 21 and the peripheral surface of the fixing belt 14.

Figure 7:
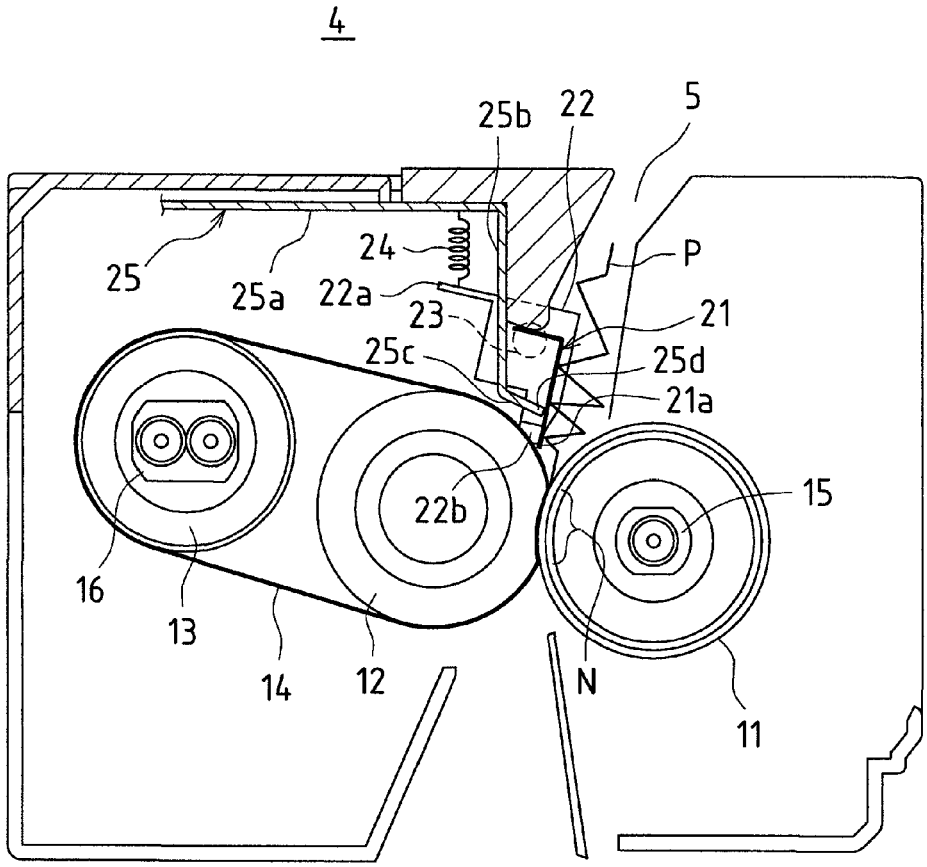
FIG. 7 is a cross-sectional view showing how the peeling plate is pushed by a recording paper that has become blocked in the nip region between the fixing belt and the pressure roller in the fixing device of FIG. 1.

In a configuration in which the restriction panel 25 is provided, even if the recording paper P becomes kinked or the like as shown in FIG. 7 such that transport of the recording paper P stalls, and the recording paper P pushes the surface of the peeling plate 21 so as to attempt to displace the peeling plate 21 in the direction C in which the leading edge 21*a* of the peeling plate 21 approaches the peripheral surface of the fixing belt 14, the rear surface of the peeling plate 21 makes contact with the contact end portion 25*d* of the restriction panel 25 such that displacement of the peeling plate 21 after contact in the direction C is prohibited. Thus, the leading edge 21*a* of the peeling plate 21 does not push against the peripheral surface of the fixing belt 14, and the peripheral surface of the fixing belt 14 is not damaged by the leading edge 21*a* of the peeling plate 21.

Here, the positioning of the leading edge 21*a* of the peeling plate 21 is achieved by contact of the leg portions 22*b* of the holders 22 against the peripheral surface of the fixing belt 14. For this reason, it is necessary to ensure that ordinarily the contact end portion 25*d* of the restriction panel 25 is apart from the rear surface of the peeling plate 21 such that the contact end portion 25*d* of the restriction panel 25 does not interfere with the positioning of the leading edge 21*a* of the peeling plate 21. Furthermore, it is also necessary to ensure that the distance apart is short between the contact end portion 25*d* of the restriction panel 25 and the rear surface of the peeling plate 21 such that even if there is an attempt to displace the peeling plate 21 in the direction C in which the leading edge 21*a* of the peeling plate 21 approaches the rear surface of the peeling plate 21, the rear surface of the peeling plate 21 immediately makes contact with the contact end portion 25*d* of the restriction panel 25 such that displacement of the peeling plate 21 in the direction C is swiftly prohibited. Accordingly, the distance apart between the contact end portion 25*d* and the rear surface of the peeling plate 21 must be set accurately by ensuring a high dimensional accuracy of the contact end portion 25*d* of the restriction panel 25 (accuracy in the length from the lower end of the support portion 25*b* to the contact end portion 25*d*).

Figure 8:
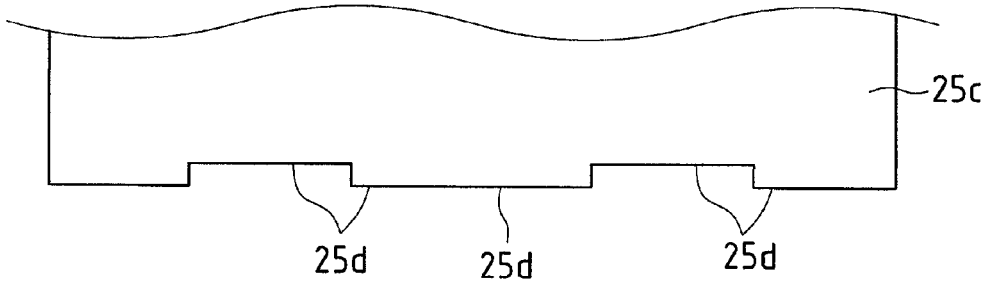
FIG. 8 is a top view showing near the leading edge of the peeling plate in the fixing device of FIG. 2.

Consequently, the contact end portion 25*d* of the restriction panel 25 is formed to have irregularities formed by protrusions and recesses as shown in FIG. 8 and the distance apart between the contact end portion 25*d* and the rear surface of the peeling plate 21 is set by regulating the length of protrusion of the protrusion locations. In this case, it is sufficient to regulate the length of the protrusion for each protrusion location of the contact end portion 25*d*, and this regulation is easily achieved. For example, in a case where the restriction panel 25 is to be formed by a punch die, the length of the protrusion locations can be regulated by regulating the dimension of positions corresponding to the protrusion locations of the contact end portion 25*d* in the punch die. Furthermore, the length of protrusion locations can be regulated without any accompanying increase in costs. Further still, it is possible to ensure that the rear surface of the peeling plate 21 is reliably brought into contact with any central or edge location of the contact end portion 25*d* of the restriction panel 25, and it is possible to prohibit displacement in the direction C for any central or edge location of the peeling plate 21.

Suppose that the contact end portion 25*d* of the restriction panel 25 was a simple straight line shape, then it would be necessary to regulate the dimensional accuracy of the entire contact end portion 25*d*, and this regulation would be difficult.

Figure 9:
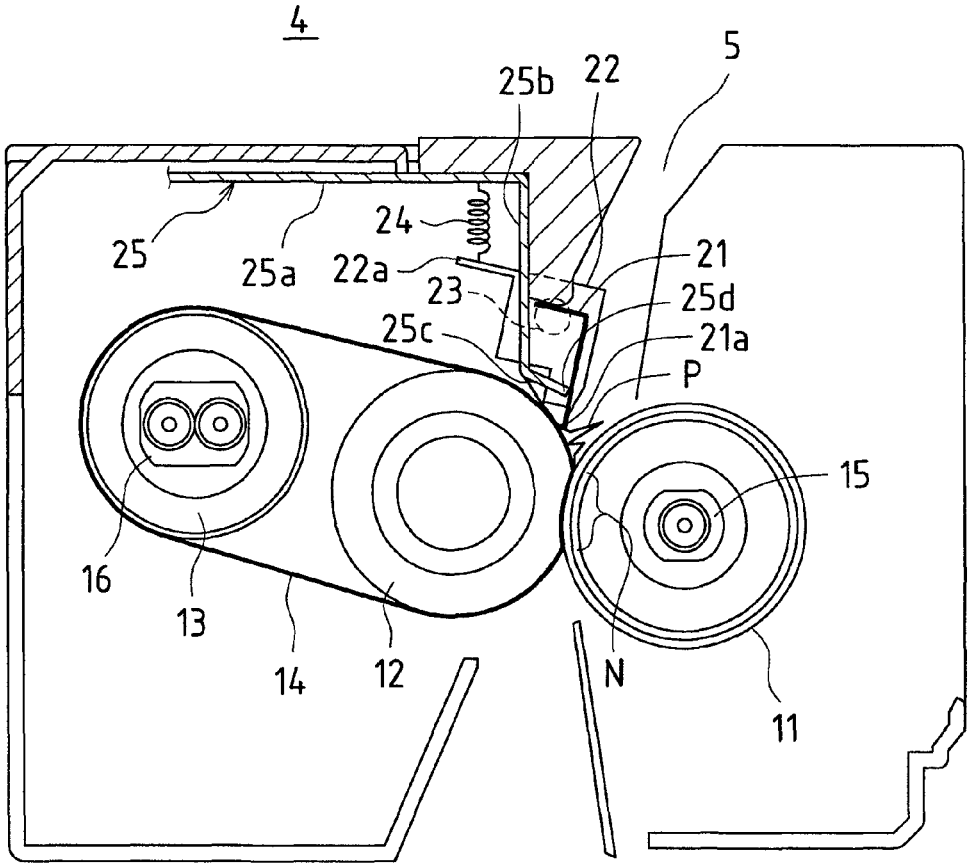
FIG. 9 is a cross-sectional view showing a process in which a recording paper passes between the peripheral surface of the fixing belt and the leading edge of the peeling plate.

Next, as shown in FIG. 9, in a case where the recording paper P has passed through and come between the peripheral surface of the fixing belt 14 and the leading edge of the peeling plate 21, the leading edge of the recording paper P strikes against the lower surface of the stopper portion 25*c* of the restriction panel 25. As stated earlier, the lower surface of the stopper portion 25*c* faces towards (is face to face with) the gap between the leading edge 21*a* of the peeling plate 21 and the peripheral surface of the fixing belt 14, and therefore the leading edge of the recording paper P reliably strikes against the lower surface of the stopper portion 25*c*. Due to this, entrance of the recording paper P to the rear surface side of the peeling plate 21 is prohibited. Thus, it does not happen that the recording paper P enters to the rear surface side of the peeling plate 21 so as to reach any sensor or thermostat near the heating assistance roller 13.

Furthermore, while the leading edge of the recording paper P strikes against the lower surface of the stopper portion 25*c*, the portion of the recording paper P downward from its leading edge is sandwiched and transported in the nip region N between the fixing belt 14 and the pressure roller 11, and therefore this portion moves to the downstream (transport direction downstream) side from the nip region N in the transport direction. Thus, the recording paper P can be easily removed.

With this fixing device 4 according to the present embodiment, even if a recording paper on the transport route becomes blocked and a jam occurs such that the surface of the peeling plate 21 is pushed by the recording paper and the peeling plate 21 is displaced in a direction such that the leading edge 21*a* of the peeling plate 21 approaches the peripheral surface of the fixing belt 14, the contact end portion 25*d* of the restriction panel 25 contacts the rear surface of the peeling plate 21 such that displacement of the peeling plate 21 after contact is prohibited, and therefore the leading edge 21*a* of the peeling plate 21 does not push against the peripheral surface of the fixing belt 14, and the fixing belt 14 does not become damaged.

Furthermore, any recording paper that passes between the leading edge 21*a* of the peeling plate 21 and the peripheral surface of the fixing belt 14 and enters to the rear surface side of the peeling plate 21 strikes against the stopper portion 25*c* of the restriction panel 25, and therefore it is possible to prevent the entire recording paper from entering to the rear surface side of the peeling plate 21.

Embodiments of the present invention are described above in detail, but the present invention is not limited to the above-described embodiments, and design modifications and the like that do not depart from the gist of the present invention are included within the scope of the present invention.

For example, in the foregoing embodiment, the pressure roller 11 and the heat roller 12 are caused to press against each other through the fixing belt 14, but the present invention is also applicable to a configuration in which the pressure roller

Figure 10:
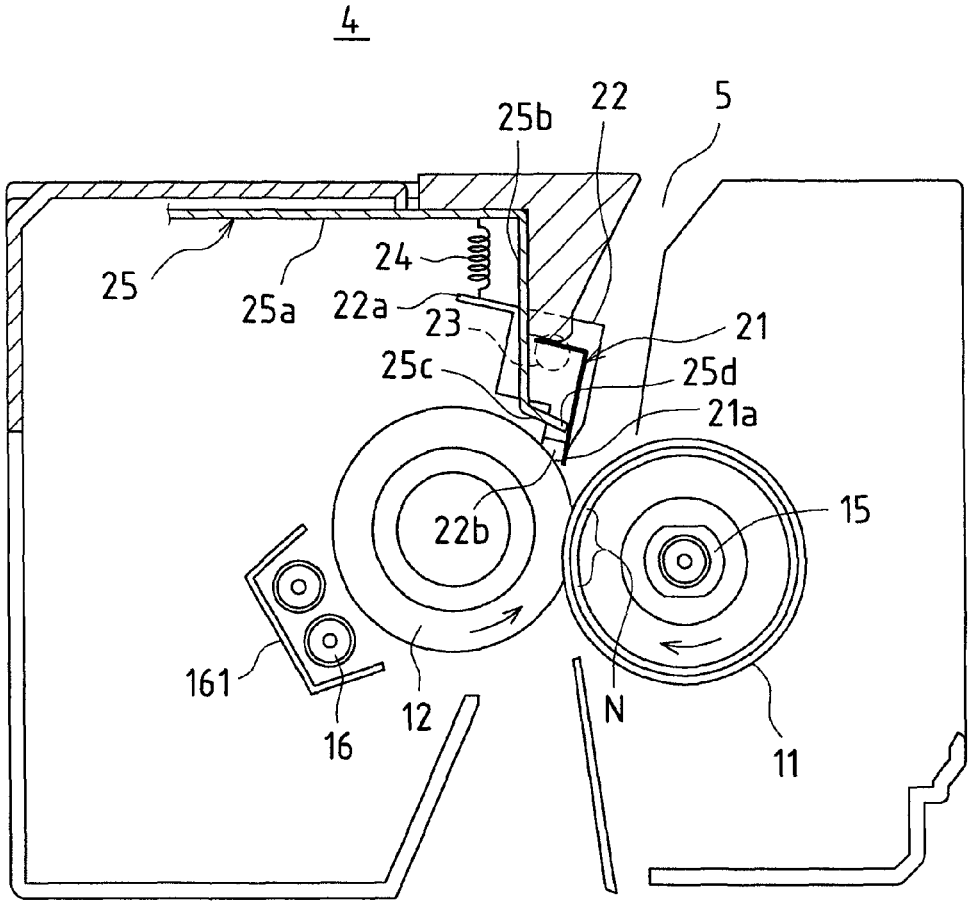
FIG. 10 is a cross-sectional view corresponding to FIG. 2 showing a fixing device according to another embodiment.

11 and the heat roller (rotation member) 12 press against each other directly. For example, as shown in FIG. 10, a configuration is possible in which the heating assistance roller 13 and the fixing belt 14 are removed, and further still heaters 16 surrounded by a reflective panel 161 are provided along the outer circumference of the heat roller 12. With the configuration shown in FIG. 10, the heaters 16 are provided outside the heat roller 12 rather than inside the heat roller 12, which has a thick elastic layer. Thus, even though the elastic layer of the heat roller 12 is thick, within a short time the surface of the heat roller 12 can be made to achieve a temperature capable of fixing.

Figure 11:
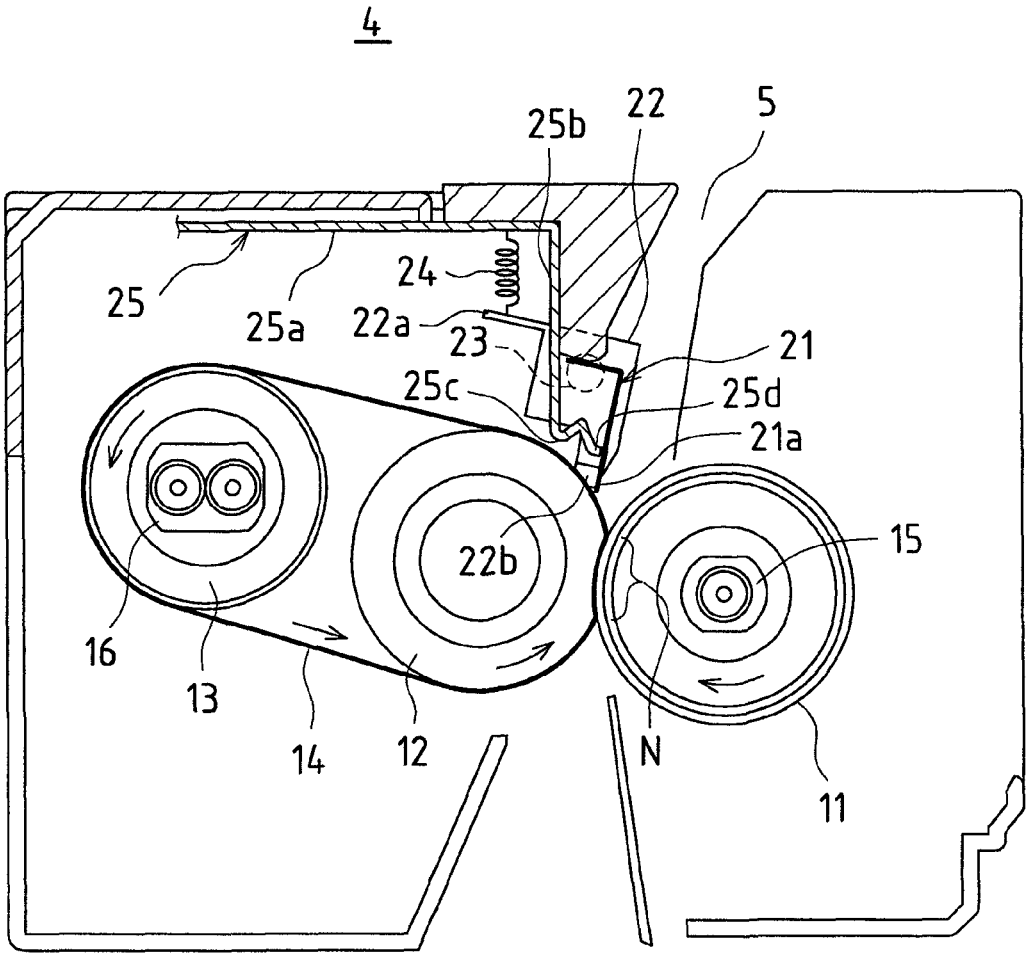
FIG. 11 is a cross-sectional view corresponding to FIG. 2 showing a fixing device according to another embodiment.

Furthermore, a recess portion may be provided to the lower surface of the stopper portion 25*c* of the restriction panel 25 such that the leading edge of the recording paper P catches more easily. For example, as shown in FIG. 11, the stopper portion 25*c* of the restriction panel 25 may be formed in a bent V shape to provide a recess portion to the lower surface of the stopper portion 25*c* of the restriction panel 25.

What is claimed is:

1. A fixing device, wherein a rotation member and a roller are caused to rotate pressing against each other, a recording paper is sandwiched and transported in a nip region between the rotation member and the roller, a leading edge of a peeling plate is positioned with respect to a peripheral surface of the rotation member, the peeling plate is provided apart from the rotation member, and the recording paper is separated from the rotation member by the peeling plate, a surface of the peeling plate faces a transport route of the recording paper, and a contact member is provided that contacts a rear surface of the peeling plate displaced in a direction in which the leading edge of the peeling plate approaches the peripheral surface of the rotation member and prohibits displacement of the peeling plate after contact of the peeling plate to the contact member, wherein the contact member is a stopper which strikes against any recording paper that has passed through between the rotation member and the peeling plate.

2. The fixing device according to claim 1, wherein the contact member is provided apart from the rear surface of the peeling plate and contacts the rear surface of the peeling plate when the leading edge of the peeling plate is displaced in a direction so as to approach the peripheral surface of the rotation member.

3. The fixing device according to claim 1, wherein the contact member has an end portion having irregularities so as to contact multiple locations of the rear surface of the peeling plate.

4. A fixing device, wherein a rotation member and a roller are caused to rotate pressing against each other, a recording paper is sandwiched and transported in a nip region between the rotation member and the roller, a leading edge of a peeling plate is positioned with respect to a peripheral surface of the rotation member, the peeling plate is provided apart from the rotation member, and the recording paper is separated from the rotation member by the peeling plate, and when the surface of the peeling plate faces the transport route of the recording paper, a stopper is provided, which any recording paper strikes against that has passed through between the leading edge of the peeling plate and the peripheral surface of the rotation member to enter to a rear surface side of the peeling plate.

5. The fixing device according to claim 4, wherein the stopper is a bent panel member, and a portion of the panel member from a bent location to a leading edge of the panel member faces between the leading edge of the peeling plate and the peripheral surface of the rotation member such that any recording paper that enters to the rear surface side of the peeling plate strikes against the portion.

6. The fixing device according to claim 1, wherein the peeling plate is arranged along a lengthwise direction of the rotation member, each end of the peeling plate is supported by a respective holder, and the leading edge of the peeling plate is positioned with respect to the peripheral surface of the rotation member by causing the holders to contact the peripheral surface of end portions of the rotation member.

7. An image forming apparatus provided with a fixing device according to claim 1.

8. The fixing device according to claim 4, wherein the peeling plate is arranged along a lengthwise direction of the rotation member, each end of the peeling plate is supported by a respective holder, and the leading edge of the peeling plate is positioned with respect to the peripheral surface of the rotation member by causing the holders to contact the peripheral surface of end portions of the rotation member.

9. An image forming apparatus provided with a fixing device according to claim 4.

10. The fixing device according to claim 1, wherein when the surface of the peeling plate faces the transport route of the recording paper, a stopper is provided, which any recording paper strikes against that has passed through between the leading edge of the peeling plate and the peripheral surface of the rotation member to enter to the rear surface side of the peeling plate.

* * * * *